US011125445B2

(12) United States Patent
Chu et al.

(10) Patent No.: US 11,125,445 B2
(45) Date of Patent: Sep. 21, 2021

(54) IMAGE PROCESSING APPARATUS FOR COOKER HOOD AND COOKER HOOD

(71) Applicant: BSH Hausgeräte GmbH, Munich (DE)

(72) Inventors: Dongyu Chu, Zhaozhuang (CN); Peter Schlotmann, Bretten (DE); Lei Yang, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 13 days.

(21) Appl. No.: 16/490,926

(22) PCT Filed: Feb. 21, 2018

(86) PCT No.: PCT/IB2018/051044
§ 371 (c)(1),
(2) Date: Sep. 4, 2019

(87) PCT Pub. No.: WO2018/163001
PCT Pub. Date: Sep. 13, 2018

(65) Prior Publication Data

US 2019/0390858 A1 Dec. 26, 2019

(30) Foreign Application Priority Data

Mar. 8, 2017 (CN) ..... 201710133535.X

(51) Int. Cl.
*F24C 15/20* (2006.01)
*F24C 15/00* (2006.01)

(52) U.S. Cl.
CPC ..... *F24C 15/2021* (2013.01); *F24C 15/006* (2013.01); *F24C 15/2042* (2013.01)

(58) Field of Classification Search
CPC .. F24C 15/2021; F24C 15/20; F24C 15/2028; F24C 15/2035; F24C 15/2042;
(Continued)

(56) References Cited

U.S. PATENT DOCUMENTS 4,286,572 A 9/1981 Searcy et al.
2010/0163549 A1* 7/2010 Gagas ..... F24C 15/2042 219/622

(Continued)

FOREIGN PATENT DOCUMENTS

CN 105299717 A 2/2016
EP 1657494 A1 5/2006

(Continued)

OTHER PUBLICATIONS

International Search Report PCT/IB2018/051044 dated May 18, 2018.

*Primary Examiner* — Jason Lau
(74) *Attorney, Agent, or Firm* — Michael E. Tschupp; Andre Pallapies; Brandon G. Braun

(57) ABSTRACT

The present invention relates to an image processing apparatus, in particular a camera apparatus and/or imaging apparatus for a cooker hood and a cooker hood. The camera apparatus includes a camera and/or the imaging apparatus includes an imaging device, an airflow generation apparatus, and an air channel, where an airflow generated by the airflow generation apparatus flows out of an outlet of the air channel. The outlet of the air channel is formed in a local area around the camera and/or imaging device. Disposing of the outlet of the air channel causes the airflow flowing out of the outlet of the air channel to form an air curtain in front of the camera and/or imaging device, thus preventing smoke from coming into contact with the camera and/or imaging device, protecting the camera and/or imaging device from pollution of smoke, and facilitating heat dissipation of the camera and/or imaging device.

29 Claims, 4 Drawing Sheets

(58) Field of Classification Search
CPC . F24C 7/083; F24C 3/126; F24C 7/08; G02B 27/0006; G02B 1/18
See application file for complete search history.

(56) References Cited

U.S. PATENT DOCUMENTS

| | | | | |
|---|---|---|---|---|
| 2015/0260193 | A1* | 9/2015 | Armstrong | F24C 15/20 415/1 |
| 2017/0303348 | A1 | 10/2017 | Kondo et al. | |
| 2019/0086096 | A1* | 3/2019 | Koetz | H05B 6/6447 |

FOREIGN PATENT DOCUMENTS

| | | | | |
|---|---|---|---|---|
| WO | WO-2016056246 | A1 * | 4/2016 | A47J 27/04 |
| WO | 2017012630 | A1 | 1/2017 | |

* cited by examiner

IMAGE PROCESSING APPARATUS FOR COOKER HOOD AND COOKER HOOD

CROSS-REFERENCES TO RELATED APPLICATIONS

This application is the U.S. National Stage of International Application No. PCT/IB2018/051264, filed Feb. 21, 2018, which designated the United States and has been published as International Publication No. WO 2018/163001 A1 and which claims the priority of Chinese Patent Application, Serial No. 201710133535.X, filed Mar. 8, 2017, pursuant to 35 U.S.C. 119(a)-(d).

BACKGROUND

Technical Field

The present invention relates to the field of cooker hoods, and in particular, to an image processing apparatus, in particular a camera apparatus or an imaging apparatus for a cooker hood and a cooker hood having same.

Related Art

With advancement of technologies, kitchen appliances trend to be intelligent. For example, a camera is installed on a cooker hood and is applicable to shooting picture or image of a cooking state below the cooker hood or capturing a user action, to generate a corresponding control command. Also imaging devices, such as projection devices are used with kitchen appliances to project content to a surface in the area of the cooker hood or below the cooker hood. However, a kitchen is different from other environments because smoke is generated during cooking. It is inevitable that there is grease in air, and this is particularly serious at the cooker hood. The camera or imaging device installed on the cooker hood is quite easy to be polluted by the grease, thus affecting the shooting effect. In addition, heat generated when the camera or imaging device operate is not easy to be dissipated.

SUMMARY

An objective of the present invention is to provide an improved image processing apparatus for a cooker hood and a cooker hood having same for at least one of the foregoing technical problems.

To achieve the foregoing technical objective, the present invention provides the following technical solution: an image processing apparatus for a cooker hood, including an image processing device, an airflow generation apparatus, and an air channel, where an airflow generated by the airflow generation apparatus flows out of an outlet of the air channel, and the outlet of the air channel is formed in a local area around the image processing device.

According to one embodiment, the invention provides the following technical solution: a camera apparatus as an image processing apparatus for a cooker hood, including a camera as an image processing device, an airflow generation apparatus, and an air channel, where an airflow generated by the airflow generation apparatus flows out of an outlet of the air channel, and the outlet of the air channel is formed in a local area around the camera.

According to a further embodiment, the invention provides the following technical solution: an imaging apparatus as an image processing apparatus for a cooker hood, including an imaging device, an airflow generation apparatus, and an air channel, where an airflow generated by the airflow generation apparatus flows out of an outlet of the air channel, and the outlet of the air channel is formed in a local area around the imaging device. The imaging device is preferably a projection device.

An image processing apparatus according to the present invention may be a camera apparatus and/or an imaging apparatus. The camera apparatus comprises at least one camera for taking pictures or otherwise capturing at least part of the surrounding of the camera. The imaging apparatus comprises at least one imaging device for emitting image(s) or other visual content. The imaging apparatus may be a projector apparatus and may comprise at least one projector device, which may also be referred to as projector. The image(s) or visual content may be media content such as movies or Internet pages. The image(s) or visual content may however also be for example the depiction of a user interface which may be projected onto a surface. In this case the projection apparatus may comprise or be connected to a camera or other sensor devices for detecting the presence of an object or movement of the object within the area of the user interface. In addition, the projection apparatus may comprise a control unit or be connected to such a control unit for deriving input commands.

The air channel is a space formed to guide air from an inlet to an outlet. The air is moved within the air channel by means of the airflow generation apparatus. The term local area describes an area in the proximity of the image processing device. Preferably, the term local area describes part of the circumference of the image processing device.

Thus, after the camera apparatus and/or imaging apparatus is installed at the cooker hood and when smoke is generated, the airflow flowing out of the outlet of the air channel may self-form an air curtain in front of the camera and/or imaging device. The smoke or steam may occur during a cooking action on a stove which is normally located below the cooker hood. Alternatively or additionally the airflow flowing out of the outlet of the air channel forms an air curtain in front of the camera and/or imaging device under the effect of an airflow generated by operating of the cooker hood. The airflow flowing out of the outlet of the air channel may thus be sucked towards a filter of the cooker hood through which air is sucked into the cooker hood by means of a fan. The air curtain formed under the effect of the airflow generated by the operation of the cooker hood thus prevents the smoke from coming into contact with the camera and/or imaging device, and protects the camera and/or imaging device from pollution of the smoke. In addition, the outlet of the air channel is formed in the local area around the camera and/or imaging device instead of an entire circumference of the cooker hood or of the camera and/or imaging device, so that all the airflow flowing out of the outlet of the air channel passes in front of the camera and/or imaging device, and no airflow is directly driven away by the airflow of the cooker hood without passing in front of the camera and/or imaging device, which would result in a waste of the airflow. In addition the airflow flowing out of the outlet of the air channel all flows with the airflow generated by operating of the cooker hood, a vortex is not easy to be generated, in particular, the forming of a vortex can be avoided, and it is avoided that some airflows may flow inversely with, in particular in an opposite direction to the airflow generated by operating of the cooker hood. On the other hand, all the airflow flowing out of the outlet of the air channel passes in front of the camera and/or imaging device, thereby further facilitating heat dissipation of the camera and/or imaging device.

The airflow generation apparatus in the present invention may be a fan, for example, an axial flow fan or a centrifugal fan. Alternatively, the centrifugal fan may be an air multiplier, which generates an airflow which again sucks in surrounding air and thus increases the amount of air in the airflow.

In addition, based on the technical objective of the present invention, the present invention further provides a solution: an image processing apparatus for a cooker hood, including an image processing device, an airflow generation apparatus, and an air channel, where an airflow generated by the airflow generation apparatus flows out of an outlet of the air channel, and disposing of the outlet of the air channel causes the airflow flowing out of the outlet of the air channel to form an air curtain in front of the image processing device.

In one embodiment, based on the technical objective of the present invention, the present invention further provides a solution: a camera apparatus as image processing apparatus for a cooker hood, including a camera as image processing device, an airflow generation apparatus, and an air channel, where an airflow generated by the airflow generation apparatus flows out of an outlet of the air channel, and disposing of the outlet of the air channel causes the airflow flowing out of the outlet of the air channel to form an air curtain in front of the camera.

In a further embodiment, based on the technical objective of the present invention, the present invention further provides a solution: an imaging apparatus as image processing apparatus for a cooker hood, including an imaging device as image processing device, an airflow generation apparatus, and an air channel, where an airflow generated by the airflow generation apparatus flows out of an outlet of the air channel, and disposing of the outlet of the air channel causes the airflow flowing out of the outlet of the air channel to form an air curtain in front of the imaging device. The imaging device is preferably a projection device.

The air curtain in front of the camera separates the camera and/or imaging device from smoke to prevent the smoke from coming into contact with the camera and/or imaging device, so as to protect the camera and/or imaging device from pollution of the smoke and guarantee the shooting effect of the camera and/or output of images from the imaging device. A user does not need to clean the camera and/or imaging device often or even after a cooking. It should be noted that in this technical solution, the air curtain is formed in front of the camera and/or imaging device because of design of the outlet of the air channel. Hence, the disposing of the outlet can also be referred to as positioning or shaping or forming of the outlet of the air channel. Similarly, the outlet of the air channel is formed in the local area around the camera and/or imaging device instead of the entire circumference of the cooker hood or of the camera and/or imaging device, which brings similar benefits with those of the foregoing solution, and details are not described herein again.

In a possible implementation manner of the present invention, the air curtain extends horizontally in front of the image processing device, in particular the camera and/or imaging device. In front of the image processing device herein means in the vicinity of the surface of the image processing device via which images are taken or emitted. The image processing device is normally installed at the cooker hood in the orientation that this surface faces down and lies in the horizontal. In that case, in front of the image processing device thus means below this surface. In this implementation manner, the air curtain extends obliquely or extends parallel in front of the camera and/or imaging device. In this way, covering of the air curtain in front of the camera and/or imaging device prevents the smoke from reaching a surface of the camera and/or imaging device.

In a possible implementation manner of the present invention, the image processing apparatus, in particular camera apparatus and/or imaging apparatus for a cooker hood includes a housing used for accommodating the camera and/or imaging device and the airflow generation apparatus, where an entrance of the housing constitutes an inlet of the air channel. The housing may have the shape of a cylinder or of a channel with a square cross section. One end of the housing may be the inlet of the air channel and the outlet of the air channel may be formed by or arranged at the opposite end of the housing. The image processing device, which is accommodated in the housing, is preferably arranged at the end of the housing where the outlet of the air channel is provided. The image processing device may at least partially extend over the end of the housing. In another embodiment the inlet and the outlet of the housing may be arranged at the same end of the housing.

In a possible implementation manner of the present invention, the housing includes a side wall, there is a flow guide portion at the outlet of the air channel, and the flow guide portion obliquely extends or perpendicularly extends relative to the side wall. The flow guide portion preferably extends over the end of the housing where the image processing device is arranged. A structure in this implementation manner is improved, so that an airflow in the air channel is guided by the flow guide portion, and the airflow flowing out of the outlet of the air channel can form the air curtain in front of the image processing device, in particular camera and/or imaging device.

In a possible implementation manner of the present invention, the air channel includes a by-pass channel that is located outside the housing and that communicates with the housing, and an outlet of the by-pass channel constitutes the outlet of the air channel.

In a possible implementation manner of the present invention, the by-pass channel is a bent channel integrally formed on the housing. For example, the by-pass channel is a smooth bent channel integrally formed on a side wall of the housing.

In a possible implementation manner of the present invention, a filter is disposed at the entrance of the housing. During cooking, air at the cooker hood and particularly below an exhaust fume collecting hood of the cooker hood mostly contains grease and the like. Air entering the housing after being cleaned by using the filter does not contain smoke or water vapor, that is, air entering the air channel is clean air after being cleaned, and air flowing out of the outlet of the air channel does not pollute the image processing device, in particular camera and/or imaging device.

In a possible implementation manner of the present invention, the image processing device, in particular camera and/or imaging device is installed at a front side of the housing, and the entrance of the housing is located at a back side of the housing relative to the image processing device, in particular camera and/or imaging device. Thus, after the housing is installed on the cooker hood with the image processing device, in particular camera and/or imaging device facing down, the entrance of the housing is located at a top surface of the housing. In this way, the entrance of the housing may optionally be located in a machine housing of the cooker hood, for example in the exhaust fume collecting hood, or be exposed at a top surface of the machine housing of the cooker hood, for example of the exhaust fume collecting hood, and image processing apparatus, in particular camera apparatus and/or imaging apparatus has a high versatility.

In a possible implementation manner of the present invention, the airflow generation apparatus is an axial flow fan. A blade of the axial flow fan pushes air to flow in a direction the same as that of an axis, so that the air enters from the entrance of the housing, that means the inlet of the air channel, at a back side of the image processing device, in particular camera and/or imaging device, and the airflow is pushed forward to flow out of the outlet of the air channel. When the image processing device is installed in the cooker hood such that the surface via which images are emitted or taken is facing down, the back side of the image processing device is the upper side of the image processing device.

In a possible implementation manner of the present invention, the entrance of the housing is located at a side surface of the housing, and the entrance of the housing, that means the inlet of the air channel, is corresponding to the image processing device, in particular camera and/or imaging device or is located at a lateral anterior side of the image processing device, in particular camera and/or imaging device. In this way, due to operating of the airflow generation apparatus, air entering from the entrance of the housing is sucked to the airflow generation apparatus, and is discharged out of an air outlet of the airflow generation apparatus. The air channel in this embodiment may thus be located in flow direction before the air flow generation apparatus. A benefit of improvement in this implementation manner is that the airflow sucked to the airflow generation apparatus flows through the image processing device, in particular camera and/or imaging device, and can remove heat generated during operation of the camera and/or imaging device, and an efficient heat dissipation of the camera and/or imaging device is implemented.

In a possible implementation manner of the present invention, the airflow generation apparatus is a centrifugal fan. The centrifugal fan ejects fluid circumferentially by using a centrifugal force after sucking the fluid in the axial direction of the fan, and a by-pass channel is correspondingly disposed on a side wall of the housing.

Based on a same inventive concept, the present invention further provides a cooker hood, including the foregoing image processing apparatus, in particular camera apparatus and/or imaging apparatus for a cooker hood.

In a possible implementation manner of the present invention, the cooker hood includes a machine housing, where a fan applicable to generating a negative pressure to suction smoke is disposed in the machine housing, the image processing apparatus, in particular camera apparatus and/or imaging apparatus, is installed on the machine housing, and the outlet of the air channel is located at a side of the image processing device, in particular camera and/or imaging device away from the fan. A benefit of designing this structure is that the flowing direction of an airflow flowing out of the outlet of the air channel is consistent or substantially consistent with that of an airflow generated by operating of the fan at the position, and no vortex is generated around the outlet of the air channel and no airflow is turbulent; or, an airflow generated by operating of the fan changes the direction of the airflow flowing out of the outlet of the air channel, so that the airflow flowing out of the outlet of the air channel forms an air curtain in front of the image processing device, in particular camera and/or imaging device.

In a possible implementation manner of the present invention, the cooker hood includes a machine housing, where a fan applicable to generating a negative pressure to suction smoke is disposed in the machine housing, the image processing apparatus, in particular camera apparatus and/or imaging apparatus, is installed on the machine housing, and in an operating state of the fan, an airflow generated by the fan causes an airflow flowing out of the outlet of the air channel to form an air curtain in front of the image processing device, in particular camera and/or imaging device. The airflow generated by operating of the fan can change the direction of the airflow flowing out of the outlet of the air channel, so that the airflow flowing out of the outlet of the air channel forms an air curtain in front of the image processing device, in particular camera and/or imaging device, thus preventing the smoke from entering the air curtain to pollute the image processing device, in particular camera and/or imaging device.

In a possible implementation manner of the present invention, the machine housing includes an exhaust fume collecting hood, and the image processing apparatus, in particular camera apparatus and/or imaging apparatus is installed on the exhaust fume collecting hood. The exhaust fume collecting hood is a member located in a lower portion of the cooker hood and is applicable to gathering the smoke. A control device and/or a display device is generally installed on the exhaust fume collecting hood. The image processing apparatus, in particular camera apparatus and/or imaging apparatus is installed on the exhaust fume collecting hood. Therefore, on the one hand, this helps the camera shoot a state on a cooktop below the cooker hood or an operation action of a user on a cooktop panel as well as the imaging apparatus to output and project clear images. On the other hand, the airflow direction of the airflow flowing out of the outlet of the air channel is easy to be consistent or substantially consistent with that of the airflow generated by the fan at the position, or the airflow generated by operating of the fan is easy to facilitate the airflow flowing out of the outlet of the air channel to form an air curtain in front of the image processing device, in particular camera and/or imaging device.

In a possible implementation manner of the present invention, the exhaust fume collecting hood defines a cavity, the cavity is separate from the fan, and the inlet of the air channel is located in the cavity. Thus, when sucking air from the inlet of the air channel, the airflow generation apparatus is not easily affected by the airflow generated by operating of the fan. In other words, the airflow generated by operating of the fan increases no windage for the airflow generation apparatus to suck an airflow.

In a possible implementation manner of the present invention, the exhaust fume collecting hood is provided with an opening communicating with the outside world, that means the surrounding of the cooker hood, and the inlet of the air channel is disposed at the opening, thus providing a possibility that air entering the air channel is directly clean air.

In a possible implementation manner of the present invention, the opening is located at a top surface of the exhaust fume collecting hood. The exhaust fume collecting hood is applicable to gathering the smoke. There is generally the smoke at a lower surface of the exhaust fume collecting hood and below the exhaust fume collecting hood, and there is generally no smoke at the top surface of the exhaust fume collecting hood. The top surface of the exhaust fume collecting hood has an opening, the inlet of the air channel is disposed at the opening, and the air entering into the air channel is relatively clean air. A benefit of this implementation manner is that the filter can be omitted, that is, no filter is installed at the inlet of the air channel.

BRIEF DESCRIPTION OF THE DRAWINGS

The disclosure will become more fully understood from the detailed description given herein below for illustration only, and thus are not limitative of the disclosure, and wherein.

DETAILED DESCRIPTION

To further understand the objectives, structures, features and functions of the present invention, detailed descriptions are given below in coordination with the embodiments.

Figure 1:
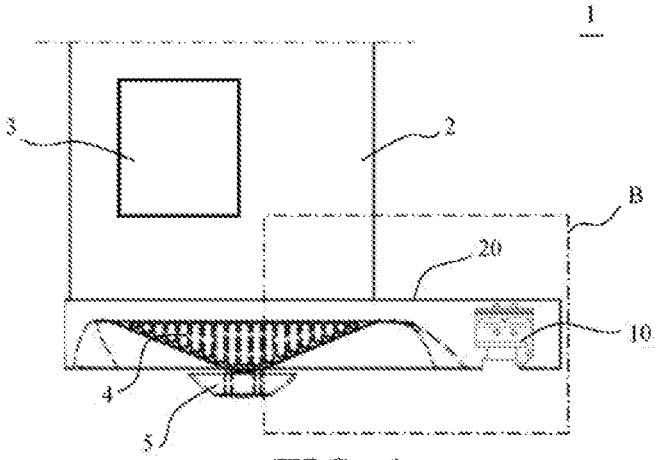
FIG. 1 is a schematic diagram of a cooker hood according to a first embodiment of the present invention.
Figure 2:
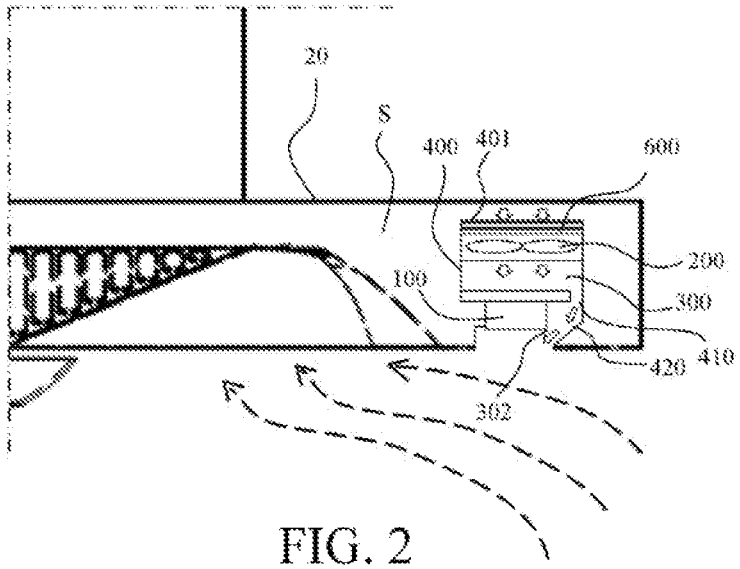
FIG. 2 is an enlarged diagram of an area B in FIG. 1.

Referring to FIG. 1 and FIG. 2, FIG. 1 is a schematic diagram of a cooker hood according to a first embodiment of the present invention; and FIG. 2 is an enlarged diagram of an area B in FIG. 1. The cooker hood 1 includes a machine housing 2, and a fan 3 applicable to generating a negative pressure for sucking smoke is disposed in the machine housing 2. The machine housing 2 includes an exhaust fume collecting hood 20 located below the fan 3. The exhaust fume collecting hood 20 defines a cavity S, and the cavity S is separate from the fan 3. A filter gauze 4 for filtering smoke and an oil cap 5 for collecting condensed grease are installed on the exhaust fume collecting hood 20. An image processing apparatus 10 is further installed on the exhaust fume collecting hood 20. The image processing apparatus 10 may be a camera apparatus or an imaging apparatus, such as a projection apparatus. The embodiments will hereinafter be described with reference to embodiments, where the image processing apparatus 10 is a camera apparatus, comprising a camera as an image processing device 100.

As shown in FIG. 2, the camera apparatus 10 includes a camera 100, an airflow generation apparatus 200 and an air channel 300. The airflow generation apparatus 200 in this embodiment is an axial flow fan, an airflow generated by the airflow generation apparatus 200 flows out of an outlet 302 of the air channel 300, and the outlet 302 of the air channel 300 is formed in a local area around the camera 100. Specifically, the outlet 302 of the air channel 300 is located at a side of the camera 100 away from the fan 3. Special disposing, that means design, of the outlet 302 of the air channel 300 causes the airflow flowing out of the outlet 302 of the air channel 300 to form an air curtain in front of the camera 100, thus preventing smoke from coming into contact with the camera 100 and protecting the camera 100 from pollution of the smoke. In addition, flowing of the airflow of the outlet 302 of the air channel 300 may strengthen heat dissipation of the camera 100. Dashed lines with arrows in FIG. 2 represent an airflow generated by operating of the fan 3, and white solid line arrows represent the airflow generated by the airflow generation apparatus 200.

The camera apparatus 10 in this embodiment includes a housing 400 used for accommodating the camera 100 and the airflow generation apparatus 200, where the housing 400 has an entrance 401 and the entrance 401 constitutes an inlet of the air channel 300. After the camera apparatus 10 is installed on the cooker hood, the entrance 401 of the housing 400 is located in the cavity S defined by the exhaust fume collecting hood 20, that is, the inlet of the air channel 300 in this embodiment is located in the cavity S. A filter 600 is disposed at the entrance 401 of the housing 400 to clean air entering the air channel 300, so that the air sucked into the air channel 300 does not contain grease and the like.

As shown in FIG. 2, the camera 100 in this embodiment is installed at a front side of the housing 400, and the entrance 401 of the housing 400 is located at a back side of the housing 400 relative to the camera 100. The camera apparatus 10 is installed on the exhaust fume collecting hood 20 of the cooker hood with the camera 100 facing down. Thus, after the camera apparatus 10 is installed, the camera 100 is correspondingly located in a bottom portion of the housing 400, and the entrance 401 of the housing is located in a top portion of the housing 400. When the airflow generation apparatus 200 operates, air is sucked from the entrance 401 in the top portion of the housing 400, and the airflow moves downward in the air channel 300 and is discharged out of the outlet 302 of the air channel. The housing 400 is a square column that is injection molded by using a plastic material. The housing 400 includes a side wall 410, there is a flow guide portion 420 at the outlet 302 of the air channel 300, and the flow guide portion 420 obliquely extends relative to the side wall 410. After the camera apparatus 10 is installed, the flow guide portion 420 extends towards the direction of the fan 3. Thus, the flow guide portion 420 makes the airflow flowing out of the outlet 302 of the air channel obliquely move forward towards the direction of the fan 3 (represented by white solid line arrows at the outlet 302 of the air channel) and form an oblique air curtain in front of the camera 100. The flowing direction of the airflow flowing out of the outlet 302 of the air channel is substantially consistent with that of the airflow generated by operating of the fan 3 at the position, and the two airflows both flow forward towards the direction of the fan 3.

Figure 3:
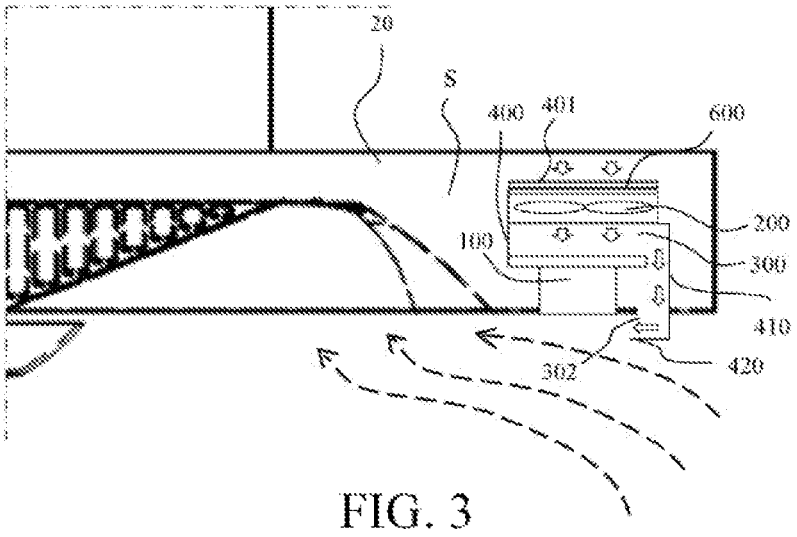
FIG. 3 is a schematic diagram of a cooker hood according to a second embodiment of the present invention.

Referring to FIG. 3, FIG. 3 is a schematic diagram of a cooker hood according to a second embodiment of the present invention. Structures and functions of elements in this embodiment are the same as those of same elements in the first embodiment, and details are not described herein again. Different from the first embodiment, the flow guide portion 420 at the outlet 302 of the air channel 300 in this embodiment perpendicularly extends relative to the side wall 410. It can be learned from FIG. 3 that the flowing direction of the airflow flowing out of the outlet 302 of the air channel is more consistent with the flowing direction of the airflow generated by operating of the fan at the position, no vortex is generated, and no airflow is turbulent at a junction of the two airflows. The flow guide portion 420 in the first embodiment obliquely extends. A vortex is possibly generated in left-front of the camera 100 and the smoke is further brought up. Thus, the smoke may possibly come into contact with a quite small exposed part of the camera. Certainly, an oblique angle of the flow guide portion 420 may be designed to reduce a possibility of generating the vortex. In addition, in comparison with the first embodiment, an air curtain horizontally extending is formed in front of the camera 100 in this embodiment. The air curtain is parallel to an exposed surface of the camera, thus more fully preventing the smoke from coming into contact with the camera, and the effect of preventing the smoke is better. In addition, the air curtain horizontally extending covers an entire exposed part of the camera, so that the heat dissipation of the camera is more uniform.

Figure 4:
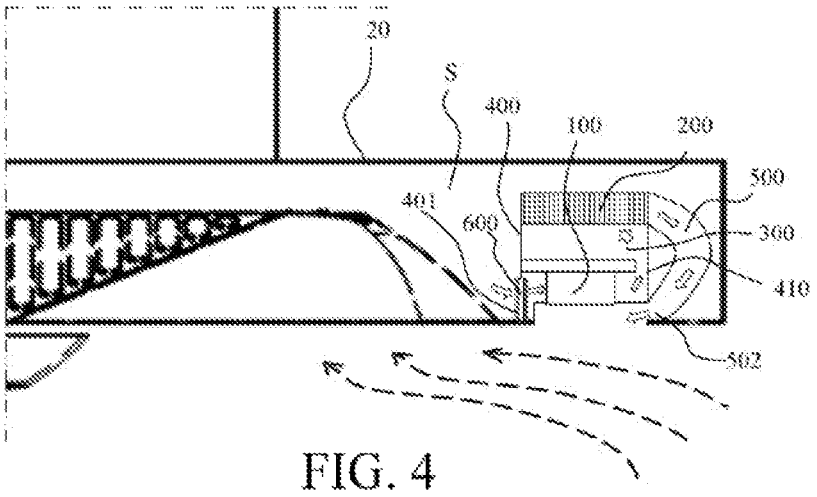
FIG. 4 is a schematic diagram of a cooker hood according to a third embodiment of the present invention.

Referring to FIG. 4, FIG. 4 is a schematic diagram of a cooker hood according to a third embodiment of the present invention. Structures and functions of elements in this embodiment are the same as those of elements having same numbers in the first embodiment, and details are not described herein again. Different from the first embodiment, the airflow generation apparatus 200 in this embodiment is a centrifugal fan. The entrance 401 of the housing 400 is located at a side surface of the housing 400, and the entrance 401 of the housing 400 is corresponding to the camera 100. A by-pass channel 500 communicating with the housing 400 is formed on the side wall 410 of the housing 400, the by-pass channel 500 is a bent channel integrally formed on the housing 400, and the housing 400 and the by-pass channel 500 are formed at a time by means of injection molding in this embodiment. An outlet 502 of the by-pass channel 500 is located in a local area around the camera 100. The outlet 502 of the by-pass channel 500 constitutes the outlet of the air channel 300. The airflow flowing out of the outlet of the air channel 300 forms the air curtain obliquely extending in front of the camera 100. In addition, the flowing direction of the airflow flowing out of the outlet of the air channel 300 is substantially consistent with that of the airflow generated by operating of the fan at the position. In comparison with the first embodiment, a further benefit of this embodiment is that because the entrance 401 of the housing is located at a side surface of the housing and is corresponding to the camera, when the airflow generation apparatus 200 operates, the air sucked from the entrance 401 flows through a part of the camera 100 located in the housing 400 during entering the airflow generation apparatus 200, and can remove some heat of the part of the camera located in the housing 400. The airflow flowing out of the outlet of the air channel can remove heat of the exposed part of the camera 100, thus implementing the heat dissipation of the camera in all directions, and the effect of heat dissipation is better.

Figure 5:
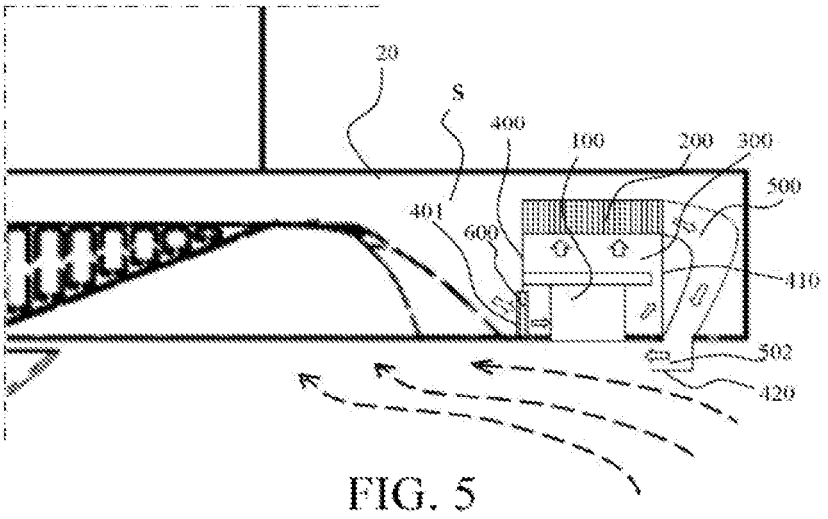
FIG. 5 is a schematic diagram of a cooker hood according to a fourth embodiment of the present invention.

Further referring to FIG. 5, FIG. 5 is a schematic diagram of a cooker hood according to a fourth embodiment of the present invention. Structures and functions of elements in this embodiment are the same as those of elements having same numbers in the third embodiment, and details are not described herein again. Different from the third embodiment, the flow guide portion 420 is disposed at the outlet of the air channel 300, that is, the outlet 502 of the by-pass channel, and the flow guide portion 420 perpendicularly extends relative to the side wall 410 of the housing 400. Thus, the airflow direction of an airflow flowing out of the outlet 502 of the by-pass channel 500 is more consistent with the flowing direction of an airflow generated by operating of the fan at the position, no vortex is generated, and no airflow is turbulent at a junction of the two airflows. An improved structure in this embodiment has the benefits of the second embodiment and the third embodiment. Refer to the corresponding descriptions of the second embodiment and the third embodiment, and details are not described herein again.

Figure 6:
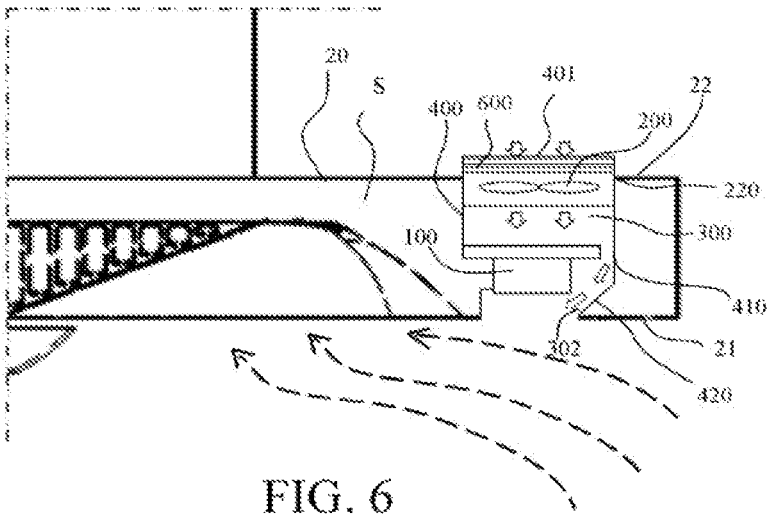
FIG. 6 is a schematic diagram of a cooker hood according to a fifth embodiment of the present invention.

Referring to FIG. 6, FIG. 6 is a schematic diagram of a cooker hood according to a fifth embodiment of the present invention. Structures and functions of elements in this embodiment are the same as those of elements having same numbers in the first embodiment, and details are not described herein again. Different from the first embodiment, the inlet of the air channel in this embodiment is located outside the cavity S defined by the exhaust fume collecting hood 20. Specifically, the exhaust fume collecting hood 20 includes a bottom surface 21 and a top surface 22 opposite to each other, and the bottom surface 21 is a surface of the exhaust fume collecting hood 20 located below the cooker hood when the exhaust fume collecting hood 20 is in an installing state. An opening 220 is provided at the top surface 22 of the exhaust fume collecting hood 20, the opening 220 communicates with the outside world, and the inlet of the air channel 300 is disposed at the opening 220. The entrance 401 of the housing 400 in this embodiment constitutes the inlet of the air channel 300, and the entrance 401 of the housing is located at the opening 220. In comparison with the first embodiment, a further benefit of this embodiment is that the air sucked into the air channel 300 from the entrance 401 of the housing is air above the exhaust fume collecting hood instead of air gathering smoke below the exhaust fume collecting hood. Thus, the air sucked into the air channel is relatively clean air. Thus, a service life of the filter at the entrance of the housing 400 is long, and a replacing or cleaning frequency is lower in comparison with that in the first embodiment. If a user is accustomed to cooking with a little smoke, the filter at the entrance 401 of the housing 400 in this embodiment may be omitted.

Figure 7:
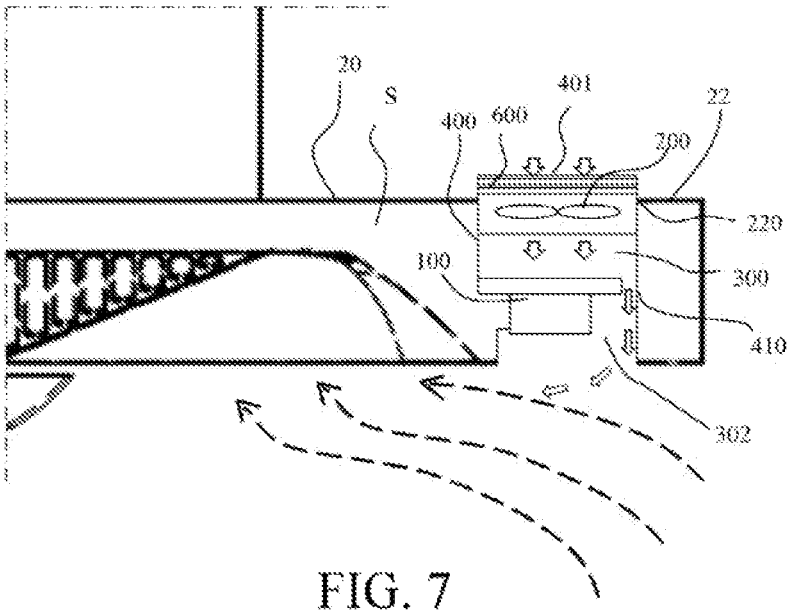
FIG. 7 is a schematic diagram of a cooker hood according to a sixth embodiment of the present invention.

Finally, referring to FIG. 7, FIG. 7 is a schematic diagram of a cooker hood according to a sixth embodiment of the present invention. Structures and functions of elements in this embodiment are the same as those of elements having same numbers in the fifth embodiment, and details are not described herein again. Different from the fifth embodiment, in an operating state of the fan of the cooker hood 1 in this embodiment, an airflow generated by the fan causes an airflow flowing out of the outlet 302 of the air channel 300 to form an air curtain in front of the camera 100. As shown in FIG. 7, when the fan is not switched on, the airflow flowing out of the outlet 302 of the air channel perpendicularly flows downward. After the fan is switched on, a negative pressure generated by the fan is large enough, so that the airflow generated by operating of the fan causes the airflow flowing out of the outlet of the air channel to deviate towards the direction of the fan, and finally to form the air curtain in front of the camera 100.

In any of the above described embodiments, the image processing apparatus 10 of the cooker hood 1 may be an imaging apparatus comprising an imaging device. One embodiment where the imaging apparatus is a projection apparatus with a projection device as imaging device will now be described with reference to FIGS. 1 and 2.

The projection apparatus 10 includes a projection device 100, which may also be referred to as projector. The projection apparatus 10 may include further components such as control units (not shown). As described above in the embodiment shown in FIGS. 1 and 2, the image processing apparatus, i.e. the projection apparatus 10 is installed on the exhaust fume collecting hood 20.

As shown in FIG. 2, the projection apparatus 10 includes a projection device 100, i.e. a projector. From the projection device 100 images may be projected down onto a surface below the cooker hood or to a wall behind the cooker hood. The images will be projected from the bottom surface of the projection device 100. The images may be content such as media content. Alternatively, the content may be for example the image of a user interface, which may be displayed on a surface below the cooker hood. In this case, the projection apparatus 10 may further include sensor means (not shown) which can sense movement of for example the user of the cooker hood in the area of the displayed user interface.

As the cooker hood comprises an airflow generation apparatus 200 and an air channel 300 and in the depicted embodiment, an airflow is generated by the airflow generation apparatus 200, the airflow flows out of an outlet 302 of the air channel 300. The outlet 302 of the air channel 300 is formed in a local area around the projection device 100, the images projected by the projection device will not be influenced by smoke. Also the projection device will be protected from coming into contact with smoke and thus from being polluted by the smoke. In addition, flowing of the airflow of the outlet 302 of the air channel may strengthen heat dissipation of the projection device 100.

Also sensing of signals at sensor means (not shown) at the projection device 100 will not be influenced by smoke or pollution at the surface of the projection device, as such pollution is prevented by the air which is provided by the air channel according to the invention.

The projection apparatus 10 includes a housing 400 used for accommodating the projection device 100 and the airflow generation apparatus 200, where the housing 400 has an entrance 401 and the entrance 401 constitutes an inlet of the air channel 300. After the projection apparatus 10 is installed on the cooker hood, the entrance 401 of the housing 40 is located in the cavity S defined by the exhaust fume collecting hood 20, that is, the inlet of the air channel 300 in this embodiment is located in the cavity S. A filter 600 is disposed at the entrance 401 of the housing 400 to clean air entering the air channel 300, so that the air sucked into the air channel 300 does not contain grease and the like.

The installation of the projection device 100 corresponds to the installation as described above with respect to the embodiment of the cooker hood with a camera apparatus as image processing apparatus In a further embodiment, the image processing apparatus may comprise at least one camera as well as at least one imaging device, such as a projector. In this embodiment, the camera and projector may be housed in a common housing. The layout of the housing may any of the layouts as shown and described with respect to FIGS. 1 to 7. It is, however, also possible, that the camera and projector may be arranged in separate housings, in that case separate airflow generation apparatuses may be provided or one single airflow generation apparatus may be arranged such that an air flow can be generated in the air channel of both housings. Also in this embodiment one common outlet may be used or separate outlets may be provided.

The present invention has been described in the foregoing related embodiments, but the foregoing embodiments are merely examples of implementing the present invention. It should be noted that the disclosed embodiment does not limit the scope of the present invention. In contrary, variations and modifications made without departing from the spirit and scope of the present invention shall fall within the protection scope of the present invention.

The invention claimed is:

1. An image processing apparatus for a cooker hood, comprising:

an image processing device having an exposed surface via which images are taken or emitted;

an air channel having an outlet formed on exactly one side of the image processing device;

an airflow generation apparatus configured to generate an airflow which flows out of the outlet of the air channel; and a housing accommodating the image processing device and the airflow generation apparatus, the housing having an entrance to constitute an inlet of the air channel;

wherein the air channel and the outlet are configured to direct the airflow to pass in front of the exposed surface of the image processing device; and wherein the housing comprises a side wall and a flow guide portion at the outlet of the air channel, the flow guide portion extending obliquely or perpendicularly relative to the side wall.

2. The image processing apparatus of claim 1, wherein the image processing device comprises a camera.

3. The image processing apparatus of claim 1, wherein the image processing device comprises a projecting device.

4. The image processing apparatus of claim 1, further comprising a filter disposed at the entrance of the housing.

5. The image processing apparatus of claim 1, wherein the image processing device is installed at a front side of the housing, said entrance of the housing being located at a back side of the housing relative to the image processing device.

6. The image processing apparatus of claim 1, wherein the airflow generation apparatus is an axial flow fan.

7. The image processing apparatus of claim 1, wherein the airflow generation apparatus is a centrifugal fan.

8. The image processing apparatus of claim 1, wherein the airflow is oblique to the exposed surface of the image processing device.

9. A cooker hood system comprising the image processing apparatus of claim 1, wherein the exactly one side of the image processing device is disposed away from an inlet of the cooker hood, such that the airflow passing in front of the exposed surface of the image processing device flows toward the inlet of the cooker hood.

10. An image processing apparatus for a cooker hood, comprising:

an image processing device having an exposed surface via which images are taken or emitted;

an air channel having an outlet formed on exactly one side of the image processing device; and an airflow generation apparatus configured to generate an airflow which flows out of the outlet of the air channel;

wherein the air channel and the outlet are configured to direct the airflow to pass in front of the exposed surface of the image processing device, such that the airflow is oblique to the exposed surface of the image processing device.

11. The image processing apparatus of claim 10, wherein the image processing device comprises a camera.

12. The image processing apparatus of claim 10, wherein the image processing device comprises a projecting device.

13. The image processing apparatus of claim 10, further comprising a housing accommodating the image processing device and the airflow generation apparatus, said housing having an entrance to constitute an inlet of the air channel.

14. The image processing apparatus of claim 13, wherein the housing comprises a side wall and a flow guide portion at the outlet of the air channel, said flow guide portion extending obliquely or perpendicularly relative to the side wall.

15. The image processing apparatus of claim 13, further comprising a filter disposed at the entrance of the housing.

16. The image processing apparatus of claim 13, wherein the image processing device is installed at a front side of the housing, said entrance of the housing being located at a back side of the housing relative to the image processing device.

17. The image processing apparatus of claim 10, wherein the airflow generation apparatus is an axial flow fan.

18. The image processing apparatus of claim 10, wherein the airflow generation apparatus is a centrifugal fan.

19. A cooker hood system comprising the image processing apparatus of claim 10, wherein the exactly one side of the image processing device is disposed away from an inlet of the cooker hood, such that the airflow passing in front of the exposed surface of the image processing device flows toward the inlet of the cooker hood.

20. A cooker hood system, comprising:

a cooker hood;

an image processing device having an exposed surface via which images are taken or emitted;

an air channel having an outlet formed on exactly one side of the image processing device; and an airflow generation apparatus configured to generate an airflow which flows out of the outlet of the air channel;

wherein the air channel and the outlet are configured to direct the airflow to pass in front of the exposed surface of the image processing device; and wherein the exactly one side of the image processing device is disposed away from an inlet of the cooker hood, such that the airflow passing in front of the exposed surface of the image processing device flows toward the inlet of the cooker hood.

21. The system of claim 20, wherein the image processing device comprises a camera.

22. The system of claim 20, wherein the image processing device comprises a projecting device.

23. The system of claim 20, further comprising a housing accommodating the image processing device and the airflow generation apparatus, said housing having an entrance to constitute an inlet of the air channel.

24. The system of claim 23, wherein the housing comprises a side wall and a flow guide portion at the outlet of the air channel, said flow guide portion extending obliquely or perpendicularly relative to the side wall.

25. The system of claim 23, further comprising a filter disposed at the entrance of the housing.

26. The system of claim 23, wherein the image processing device is installed at a front side of the housing, said entrance of the housing being located at a back side of the housing relative to the image processing device.

27. The system of claim 20, wherein the airflow generation apparatus is an axial flow fan.

28. The system of claim 20, wherein the airflow generation apparatus is a centrifugal fan.

29. The system of claim 20, wherein the airflow is oblique to the exposed surface of the image processing device.

* * * * *